United States Patent [19]

Steiner et al.

[11] Patent Number: 4,492,893

[45] Date of Patent: Jan. 8, 1985

[54] DUAL FILAMENT HALOGEN CYCLE AUTOMOTIVE-TYPE INCANDESCENT LAMP

[75] Inventors: Hermann Steiner, Herbrechtingen; Walter Schonherr, Giengen-Hürben, both of Fed. Rep. of Germany

[73] Assignee: Patent-Treuhand Gesellschaft fur elektrische Gluhlampen GmbH, Munich, Fed. Rep. of Germany

[21] Appl. No.: 393,776

[22] Filed: Jun. 30, 1982

[30] Foreign Application Priority Data

Jul. 22, 1981 [DE] Fed. Rep. of Germany ... 8121528[U]

[51] Int. Cl.[3] ..... H01J 5/48; H01J 5/56; H01J 5/58

[52] U.S. Cl. ..... 313/318; 313/315; 339/144 R

[58] Field of Search ..... 313/579, 113, 318, 115, 313/25, 315; 339/144 R, 145 R

[56] References Cited

U.S. PATENT DOCUMENTS 4,013,335 3/1977 Varkonyi et al. ..... 313/318 X 4,384,236 5/1983 Hellwig et al. ..... 313/318

4,396,860 8/1983 Hellwig et al. ..... 339/145 R

FOREIGN PATENT DOCUMENTS 7822290 1/1980 Fed. Rep. of Germany .

*Primary Examiner*—David K. Moore

*Assistant Examiner*—K. Wieder

*Attorney, Agent, or Firm*—Frishauf, Holtz, Goodman & Woodward

[57] ABSTRACT

To provide for cementless attachment of a halogen cycle incandescent bulb (4) to a positioning ring (2) formed with a flange-like extension (6*a*) and a generally sleeve-like projection (6), the press stem (5) of the lamp is placed in a stem holder (1) which has a sleeve-like portion, fitted between lugs (11) extending in the direction of the sleeve-like portion of the positioning ring, the lugs being welded to the stem holder at selected circumferential positions. Assembly, alignment and adjusment of this structure is facilitated with respect to structures in which lugs are bent-over at right angles from a base holder.

5 Claims, 7 Drawing Figures

DUAL FILAMENT HALOGEN CYCLE AUTOMOTIVE-TYPE INCANDESCENT LAMP

The present invention relates to a halogen cycle incandescent lamp, and more particularly to a dual filament halogen cycle incandescent lamp suitable for automotive headlights, in which the press stem of the bulb element is secured to a holder without cement.

BACKGROUND

Cementless holding arrangements for the bulbs of halogen cycle incandescent lamps are known; in such lamps, the press stem of the bulb is secured in a base without attaching cement, the base then being attached to a holder for placement and holding of the lamp in a socket, or in a reflector housing. The holder may be shaped in disc form with lugs which extend generally parallel to the longitudinal axis of the lamp. The lugs are bent off at right angles. The right angle lugs are welded to a positioning ring. The positioning ring is combined with the base shell to form an interfitting group or assembly; it may also be formed as a single element deep drawn structure. In manufacture, the lamp bulb and the holder are assembled to form a subassembly which is then placed on a positioning ring, adjusted to accurately locate the focal point of the filaments with respect to the ring, for subsequent welding of the lugs with the ring to maintain the adjustment (see German Utility Model DE-GM No. 78 22 290).

THE INVENTION

It is an object of the present invention to simplify the construction of the lamp to permit use of machinery suitable for high quantity production which easily and with high accuracy permit adjustment of the lamp bulb, enhance the filament with respect to the ring.

Briefly, the holder is made cup-shaped. The attachment or welding lugs are axially extending projections which are formed on an adjustment structure which includes axially directed portions besides a ring or flange element. For assembly, the holder is inserted in the adjustment ring or flange structure, and the lugs are then welded to the wall of the holder.

DESCRIPTION OF THE EMBODIMENT

Figure 4:
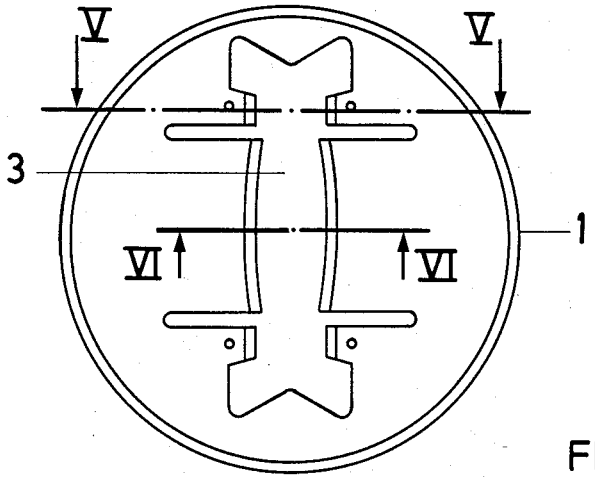
FIGS. 4, 5 and 6 show a cup-shaped holder in top plan view, section along lines V—V and section along lines VI—VI, respectively.
Figure 5:
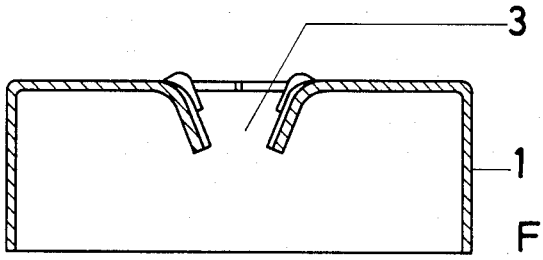
Figure 6:
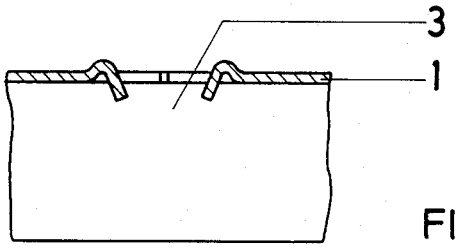

A cup-shaped holder 1 of circular cross section, best seen in FIGS. 4–6 is provided and formed with an opening 3 to receive the base 5 of the bulb 4 of a two-filament halogen incandescent lamp. The holder 1 mechanically retains the press stem 5 of the lamp 4 in position. A positioning ring 2 is formed as a deep drawn metal element having a socket-type sleeve 6 extending therefrom in axial direction, and a laterally projecting ring-shaped flange extension 6*a*. The sleeve end 6 is connected to a base plate or disc 8, formed with openings 9 to carry connecting leads 10 from lamp 4 to contact lugs 7. Contact lugs 7, via connections 10 supply the electric current to the lamp 4.

Figure 1:
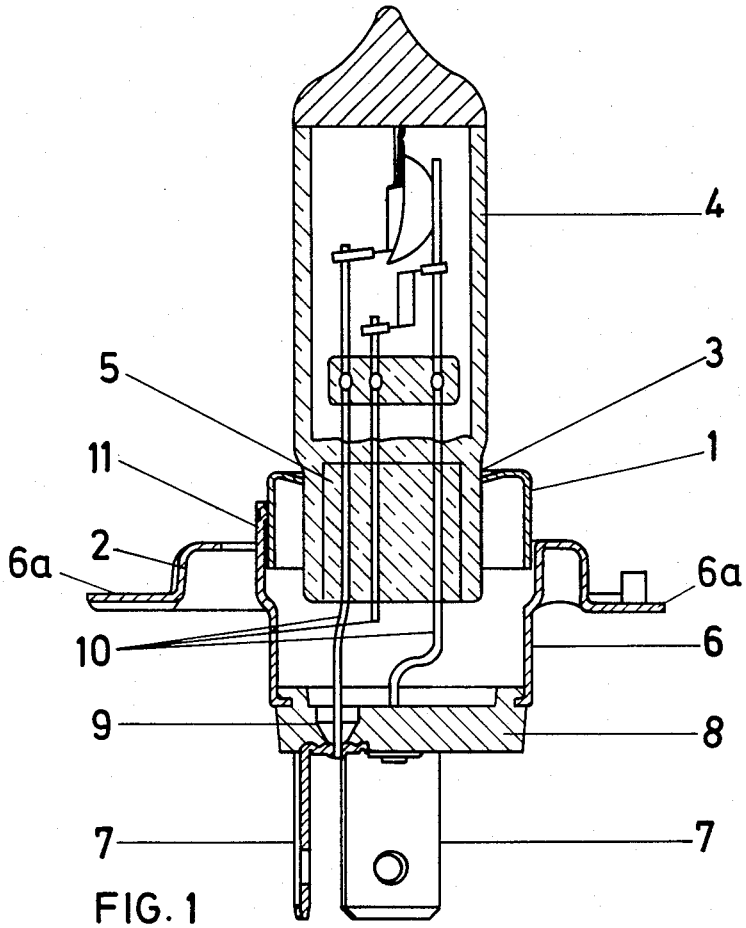
FIGS. 1–3 show in upright section, plan view and top view, respectively, a dual filament halogen cycle incandescent lamp, with base structure attached.
Figure 2:
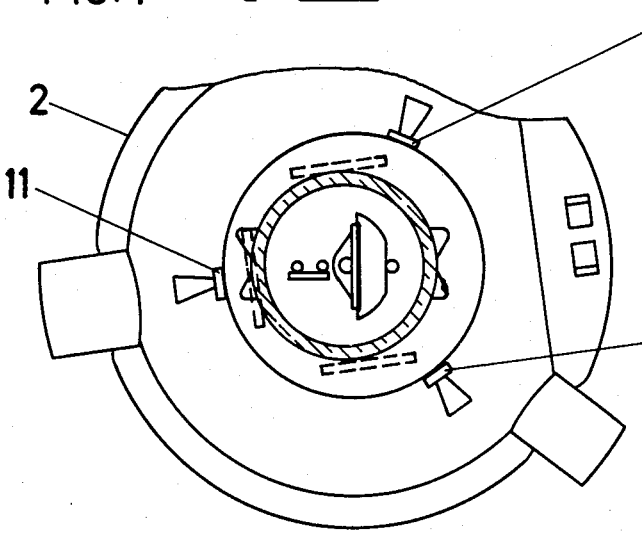
Figure 3:
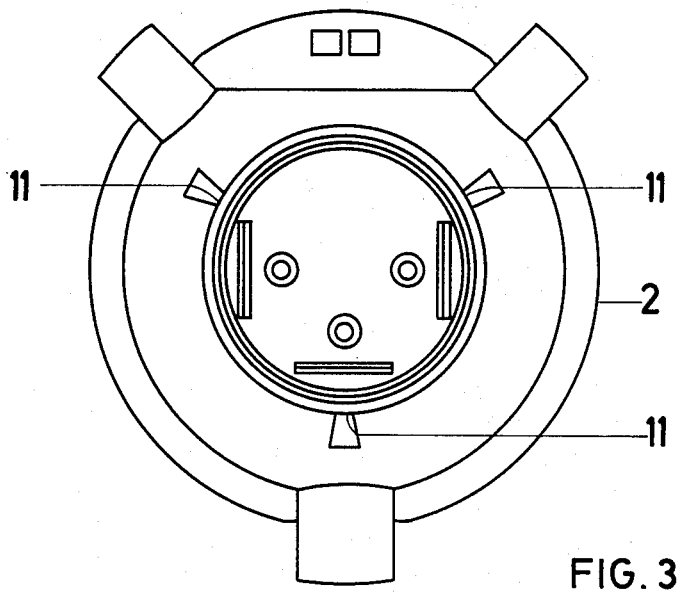
Figure 7:
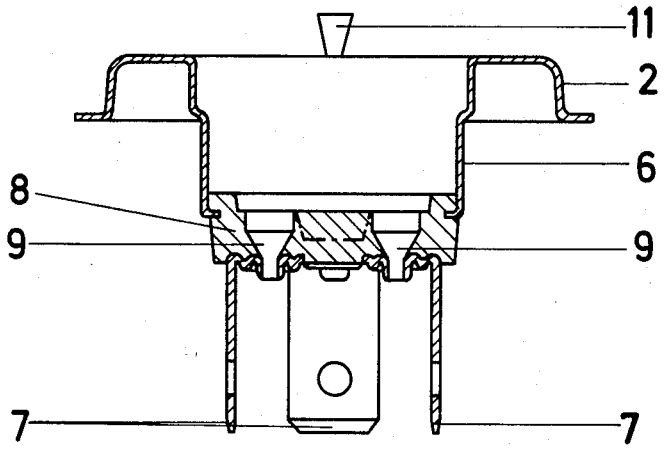
FIG. 7 is an axial side view of the base shell with an adjustment ring forming a single piece deep-drawn member, combined with a base insulator disc, and also illustrating connecting contact lugs.

The holder 1, preferably with the lamp 4 already assembled thereto as a subassembly is fitted into the sleeve-like portion 6 of the positioning ring 2. The sleeve-like portion of the holder 1 is telescopically received, in part, in the sleeve-like portion 6 of the ring 2 with a region of the holder 1 remaining free and projecting outwardly from the portion 6 (see FIG. 1). Attachment lugs 11 are punched outwardly to extend in axial direction from the material of the positioning ring 2; in actual manufacture, the lugs 11 can extend from the sleeve-like portion 6 without bending, the flange portion 6*a* being bent over from the sleeve portion, with the lugs 11 left standing from punched out portions of the flange 6*a*. The flaps 11, which have not been bent or deformed are then welded to the outwardly projecting region of the outer wall of the holder 1; the flaps 11 extend, essentially, parallel to the outer walls of the holder 1.

Lamp 4 and holder 1 are assembled in form of a subassembly; the positioning ring 2, together with the socket sleeve 6 and the base disc 8, carrying the contact lugs 7 form another subassembly. Both subassemblies are fitted together, and after alignment in the desired position with respect to each other, the flaps 11 are welded to the walls of the holder 1. The current connecting leads 10 are bonded with the contact lugs 7, threaded through the openings 9 in the base disc 8. Bonding can be by soldering, or welding.

The entire construction is without cement and securely holds the bulb 4 in position.

Various changes and modifications may be made within the scope of the inventive concept.

As clearly seen in the drawings, the sleeve extension 6 of the positioning ring 2 is formed with a stepped upper portion, which receives the sleeve portion of the holder 1. The sleeve holder 1 thus can be aligned with respect to the flat surface of the flange 6*a* of the positioning ring for proper positioning of the filament in the bulb 4 with respect to the flange—which determines the focal position with respect to a reflector and the lugs 11 then welded in place. The telescoping fit between the sleeve portion of the holder 1 and the upper portion of the sleeve 6 provides for secure positioning, and the aligned location of the lugs 11 with respect to the holder 1, securely attaches the holder 1 in the predetermined location with respect to the positioning ring 2, and preventing misalignment due to a bad connection, even if subjected to vibration or shock, unavoidable in lamps destined for automotive use.

We claim:

1. Cementless halogen cycle incandescent lamp and base combination, especially dual filament lamp for motor vehicle headlight having a lamp bulb (4) and a press stem (5) extending from the bulb;

a stem holder (1) retaining the lamp bulb therein and having a sleeve-like tubular portion surrounding the press stem, a positioning ring (2) formed with a flange-like portion (6*a*), a depending sleeve-like portion (6) which telescopically surrounds the sleeve-like tubular portion of the stem holder (1) and further formed with at least three upstanding lugs (11) extending from the sleeve-like portion in alignment therewith and in a direction perpendicular with respect to the flange-like portion (6*a*) and in axial direction with respect to the lamp bulb along the outer wall of the tubular, sleeve-like portion;

and wherein the sleeve-like tubular portion of the stem holder (1) projects outwardly from the depending sleeve-like portion (6) of the positioning ring (2) to define an outwardly extending region which is free from telescopic engagement with the depending sleeve-like portion of the positioning ring; and the upstanding lugs of the positioning ring (2) are fitted against and welded to said outwardly extending region of the stem holder of the sleeve-like tubular portion of the stem holder, whereby the relative alingment of the bulb (4) and the positioning ring (2) can be determined by positioning of the stem holder with respect to the upstanding lugs in accordance with the desired alignment before welding of the lugs to the stem holder.

2. A lamp according to claim 1 wherein the lugs (11) are formed by material from the flange-like portion (6*a*) of the positioning ring (2).

3. A lamp according to claim 1 wherein the positioning ring is an integral element including said sleeve-like portion (6), said lugs (11), and said flange-like portion (6*a*).

4. A lamp according to claim 1 wherein the sleeve-like portion of the stem holder (1) is dimensioned to fit, snugly, within the sleeve-like depending portion (6) of the positioning ring, said lugs extending parallel and around the portions of the circumference of the sleeve-like portion of the stem holder to define, together with the depending sleeve-like portion of the positioning ring, an essentially aligned continuous surface adjacent the sleeve-like portion of the stem holder.

5. Based cementless halogen cycle incandescent lamp, especially lamp for motor vehicle headlights, having a lamp bulb (4) and a stem press (5) extending from the bulb;

a stem holder (1) retaining the lamp bulb, said stem holder having a sleeve-like tubular portion surrounding the stem press;

a positioning ring (2) formed with a lateral flange-like portion (6*a*) and a depending sleeve-like tubular portion (6), dimensioned to fit telescopically snugly around a portion of the sleeve-like portion of the stem holder (1) while leaving an outwardly extending region of the sleeve-like portion of the stem holder (1) free from telescopic engagement with the depending sleeve-like portion of the positioning ring (2);

a base plate (8) secured to the end of the sleeve-like depending portion (6) of the positioning ring remote from the engagement with the stem holder (1);

terminal lugs (7) secured to the base plate (8) and electrically connected to said bulb;

and at least three upstanding connecting lugs (11) extending in axial direction with respect to the lamp bulb along the outer wall of the tubular sleeve-like portion of the stem holder (1) and fitted against and welded to the outwardly extending region of the sleeve-like portion of the stem holder (1) to position the stem holder (1) and hence the bulb (4) in predetermined position of alignment of the axis of the bulb (4) with respect to the axis of the depending sleeve-like portion (6) of the positioning ring, and hence with respect to the lateral flange-like portion (6*a*) of the positioning ring.

* * * * *